US008563887B2

(12) United States Patent
Gottschalk et al.

(10) Patent No.: US 8,563,887 B2
(45) Date of Patent: Oct. 22, 2013

(54) ELECTRICAL SWITCHING APPARATUS AND TRIP LATCH ASSEMBLY THEREFOR

(75) Inventors: Andrew Lawrence Gottschalk, Monaca, PA (US); Paul R. Rakus, Beaver Falls, PA (US)

(73) Assignee: Eaton Corporation, Cleveland, OH (US)

( * ) Notice: Subject to any disclaimer, the term of this patent is extended or adjusted under 35 U.S.C. 154(b) by 196 days.

(21) Appl. No.: 13/333,193

(22) Filed: Dec. 21, 2011

(65) Prior Publication Data

US 2013/0161169 A1 Jun. 27, 2013

(51) Int. Cl.
*H01H 5/00* (2006.01)

(52) U.S. Cl.
USPC ..... 200/468; 200/400; 200/318

(58) Field of Classification Search
USPC ..... 200/400, 401, 424, 425, 318, 323, 325, 200/500
See application file for complete search history.

(56) References Cited

U.S. PATENT DOCUMENTS 4,125,008 A 11/1978 Genest et al.
6,015,959 A * 1/2000 Slepian et al. ..... 200/400
6,246,304 B1 * 6/2001 Gasper ..... 335/17
6,437,269 B1 8/2002 Rakus
6,492,607 B2 * 12/2002 Bruckert et al. ..... 200/401
7,294,804 B1 11/2007 Gottschalk et al.
7,449,652 B2 11/2008 Rakus et al.
7,449,653 B2 * 11/2008 Gibson et al. ..... 200/400
7,518,076 B1 4/2009 Gottschalk et al.
8,058,580 B2 11/2011 Gottschalk et al.
8,063,328 B2 11/2011 Gottschalk et al.

* cited by examiner

*Primary Examiner* — Kyung Lee
(74) *Attorney, Agent, or Firm* — Eckert Seamans Cherin & Mellott, LLC; Grant E. Coffield

(57) ABSTRACT

A trip latch assembly is provided for an electrical switching apparatus, such as a circuit breaker. The circuit breaker operating mechanism includes a pole shaft. The trip latch assembly includes a trip latch pivotably coupled to the circuit breaker housing and being movable between a latched position and an unlatched position. A trip latch reset spring is structured to bias the trip latch toward the latched position. A spring housing at least partially overlays the trip latch reset spring. A trip latch spring link includes a first end movably coupled to the pole shaft, and a second end cooperating with the spring housing. When the circuit breaker needs to be reset, the trip latch spring link engages the spring housing, in order apply torque to the trip latch reset spring. When the circuit breaker is closed, the bias of the trip latch reset spring on the trip latch is removed.

20 Claims, 4 Drawing Sheets

ELECTRICAL SWITCHING APPARATUS AND TRIP LATCH ASSEMBLY THEREFOR

BACKGROUND

1. Field

The disclosed concept relates generally to electrical switching apparatus and, more particularly, to electrical switching apparatus, such as circuit breakers. The disclosed concept also relates to trip latch assemblies for electrical switching apparatus.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism, which opens electrical contact assemblies to interrupt the flow of current through the conductors of an electrical system in response to such fault conditions as detected, for example, by a trip unit. The electrical contact assemblies include stationary electrical contacts and corresponding movable electrical contacts that are separable from the stationary electrical contacts.

Among other components, the operating mechanisms of some low and medium voltage circuit breakers, for example, typically include a pole shaft, a trip actuator assembly, a closing assembly and an opening assembly. The trip actuator assembly responds to the trip unit and actuates the operating mechanism. The closing assembly and the opening assembly may have some common elements, which are structured to move the movable electrical contacts between a first, open position, wherein the movable and stationary electrical contacts are separated, and a second, closed position, wherein the movable and stationary electrical contacts are electrically connected. Specifically, the movable electrical contacts are coupled to the pole shaft. Elements of both the closing assembly and the opening assembly, which are also pivotably coupled to the pole shaft, pivot the pole shaft in order to effectuate the closing and opening of the electrical contacts.

For example, typically when the circuit breaker is open, a trip latch spring applies torque to a trip latch to reset the circuit breaker and prepare it for closing. If, however, the circuit breaker does not reset, for example because of relatively weak spring force, the circuit breaker will attempt to close but be unable to because the trip latch is not reset. This can result in damage to circuit breaker components. Furthermore, the problem is exacerbated by the desire to use as few springs as possible with the smallest spring force possible for resetting in an attempt to avoid an undesirable balance of springs, wherein some springs (e.g., without limitation, opening springs) are trying to open the breaker and some springs (e.g., without limitation, closing springs) are trying to close the breaker.

There is, therefore, room for improvement in electrical switching apparatus, such as circuit breakers, and in trip latch assemblies therefor.

SUMMARY

These needs and others are met by embodiments of the disclosed concept, which are directed to a trip latch assembly for electrical switching apparatus such as, for example and without limitation, circuit breakers. Among other benefits, the trip latch assembly functions to substantially remove spring torque when the circuit breaker is closed.

As one aspect of the disclosed concept, a trip latch assembly is provided for an electrical switching apparatus. The electrical switching apparatus includes a housing, separable contacts enclosed by the housing, and an operating mechanism for opening and closing the separable contacts. The operating mechanism includes a pole shaft. The trip latch assembly comprises: a trip latch structured to be pivotably coupled to the housing, the trip latch being movable between a latched position and an unlatched position; a trip latch reset spring structured to bias the trip latch toward the latched position; a spring housing at least partially overlaying the trip latch reset spring; and a trip latch spring link including a first end structured to be movably coupled to the pole shaft and a second end structured to cooperate with the spring housing. When the electrical switching apparatus needs to be reset, the trip latch spring link is structured to engage the spring housing, in order apply torque to the trip latch reset spring. When the electrical switching apparatus is closed, the bias of the trip latch reset spring on the trip latch is removed.

The spring housing may comprise a first portion, a second portion disposed opposite and distal from the first portion, and a body portion extending between the first portion and the second portion. The first portion may cooperate with the trip latch reset spring, and the second portion may cooperate with the trip latch spring link The first portion of the spring housing may comprise a flange and a number of protrusions, wherein the flange extends radially outwardly from the body portion of the spring housing, and wherein the protrusions extend outwardly from the flange toward the trip latch. The number of protrusions may be a first protrusion and a second protrusion. The first protrusion may cooperate with the trip latch and the trip latch reset spring, and the second protrusion may at least partially overlay and retain the trip latch reset spring.

The trip latch reset spring may be a torsion spring. The torsion spring may include a first end, a second end, and a number of coils. The first end of the torsion spring may engage the trip latch. The second end of the torsion spring may engage the second protrusion. The first protrusion and the second protrusion may at least partially overlay the coils. The torsion spring may be disposed on the shaft between the flange of the spring housing and the trip latch.

The second portion of the spring housing may comprise a paddle extending outwardly from the body portion. The second end of the trip latch spring link may be structured to cooperate with the paddle in order to translate movement of the pole shaft into movement of the spring housing. The second end of the trip latch spring link may include a recess and an edge, wherein the paddle extends into the recess and cooperates with the edge. The first end of the trip latch spring link may include an elongated slot, and the pole shaft may include a pin member. The pin member may be structured to move within the elongated slot in order that movement of the pole shaft is translated into movement of the spring housing only when it is desired to apply torque to the trip latch reset spring to bias the trip latch toward the latched position and reset the electrical switching apparatus.

In accordance with another aspect of the disclosed concept, an electrical switching apparatus employing the aforementioned trip latch assembly, is provided.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
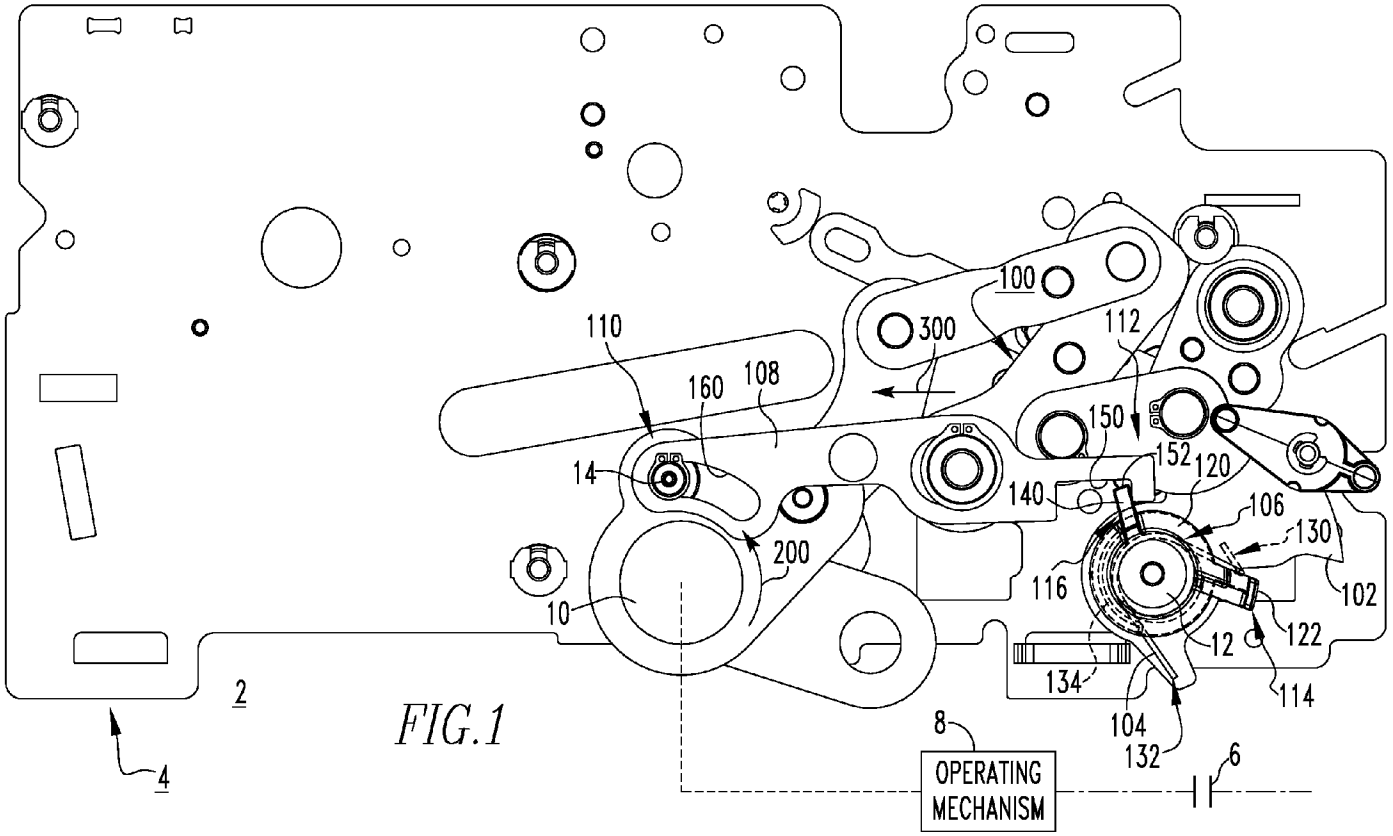
FIG. 1 is an elevation view of a portion of a circuit breaker and trip latch assembly therefor, in accordance with an embodiment of the disclosed concept, wherein the breaker is shown tripped and discharged.

Directional phrases used herein, such as, for example, left, right, clockwise, counterclockwise and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows a trip latch assembly 100 for an electrical switching apparatus such as, for example and without limitation, a circuit breaker 2 (partially shown in FIGS. 1 and 2), in accordance with the disclosed concept. The circuit breaker 2 includes a housing 4 (partially shown in FIGS. 1 and 2), separable contacts 6 (shown in simplified form in FIG. 1), and an operating mechanism 8 (shown in simplified form in FIG. 1) for opening and closing the separable contacts 6. The operating mechanism 8 includes a pole shaft 10. The trip latch assembly 100 includes a trip latch 102 (best shown in FIGS. 3-6), which is pivotably coupled to the circuit breaker housing 4 and is movable between a latched position (see, for example, FIG. 2) and an unlatched position (see, for example, FIG. 1). The trip latch assembly 100 further includes a trip latch reset spring 104 (shown in hidden line drawing in FIGS. 1 and 2; best shown in the exploded isometric views of FIGS. 3 and 5). The trip latch reset spring 104 is structured to bias the trip latch 102 toward the latched position. A spring housing 106 at least partially overlays the trip latch reset spring 104, as shown in FIGS. 1, 2, 4 and 6.

Figure 2:
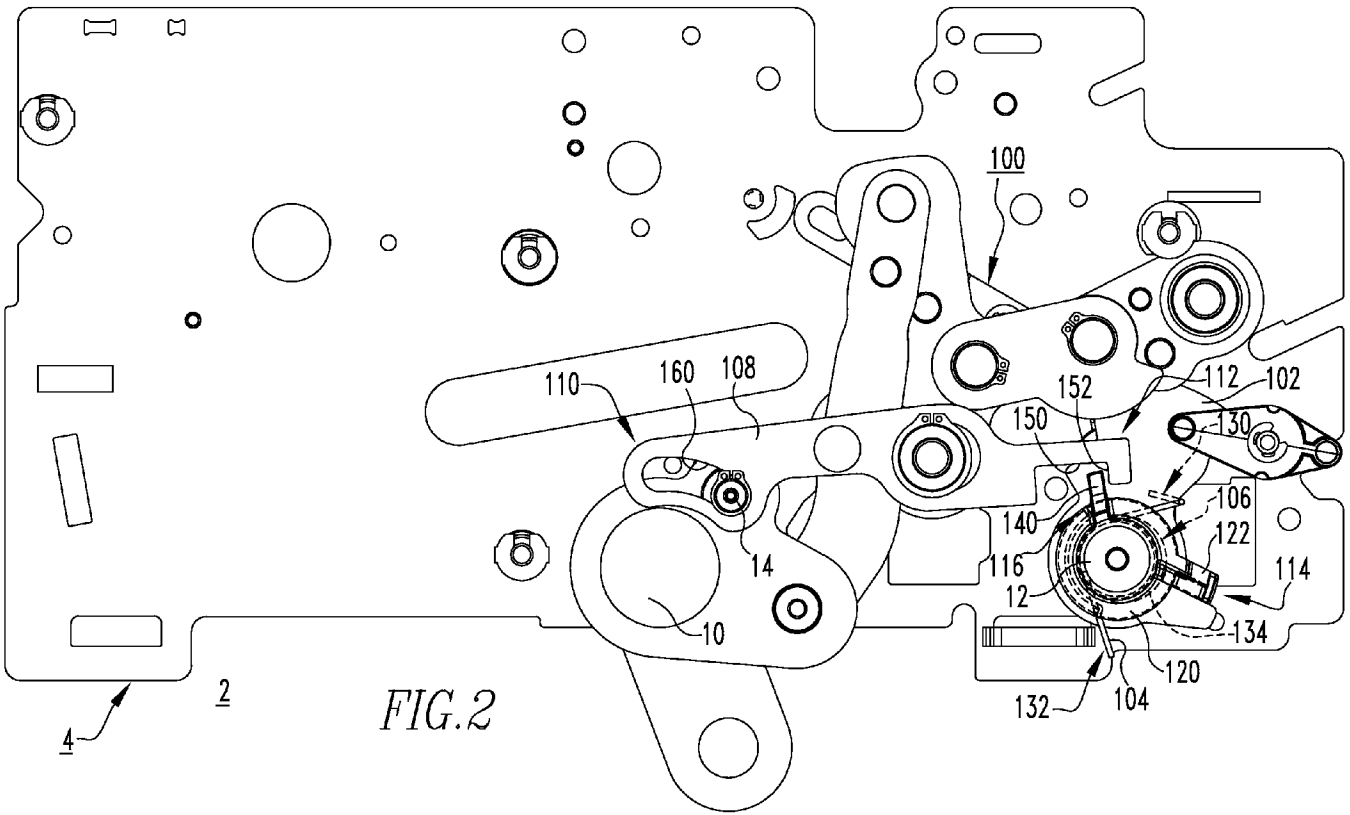
FIG. 2 is the elevation view of FIG. 1, modified to show the circuit breaker closed.

As shown in FIGS. 1 and 2, a trip latch spring link 108 includes first and second opposing ends 110,112. The first end 110 is movably coupled to the circuit breaker pole shaft 10, and the second end 112 is structured to cooperate with the spring housing 106. More specifically, when the circuit breaker 2 needs to be reset, for example and without limitation after the breaker has tripped and discharged, as shown in FIG. 1, the trip latch spring link 108 engages the spring housing 106, in order to apply torque to the trip latch reset spring 104 to bias the trip latch 102 toward the latched position, shown in FIG. 1. Accordingly, it will be appreciated that in accordance with the disclosed concept, the trip latch reset spring 104 only biases the trip latch 102 when the circuit breaker 2 needs to be reset.

In other words, torque is removed from the trip latch 102 when the circuit breaker 2 is closed. Among other benefits, this results in all variability from the trip latch reset spring 104 being removed. The assembly is also adjustable to ensure the proper time when the spring force is removed from the trip latch 102, and the requirement for maintaining precise tolerances is relaxed. That is, the prior art problem of having a balance of springs wherein some springs are trying to open the circuit breaker 2 and other springs are trying to reset the circuit breaker 2, is removed. Thus, the force tolerance of the reset spring 104 is advantageously not a contributor to holding the circuit breaker 2 from tripping. Accordingly, only the moment arms of the toggle linkages and tripping system contribute to tolerance variation of the force applied to the trip D-shaft. Therefore, the force of the accessories needed in order to trip the circuit breaker 2 can also be less. Additionally, because the trip latch rest spring 104 is only used when the circuit breaker 2 needs to be reset, the spring 104 can be large enough to provide a margin of reliability associated with resetting the circuit breaker 2. Moreover, as will be further discussed herein, the spring 104 is also at least partially contained within the spring housing 106 such that it can be preloaded, as desired.

As best shown in FIGS. 3-6, the spring housing 106 of the non-limiting example trip latch assembly 100, shown and described herein, includes a first portion 114, a second portion 116 disposed opposite and distal from the first portion 114, and a body portion 118 extending therebetween. The first portion 114 cooperates with the trip latch reset spring 104, and the second portion 116 cooperates with the trip latch spring link 108 (FIGS. 1 and 2). The body portion 118 of the spring housing 106 preferably comprises an elongated sleeve member, which is disposed on the pivotable shaft 12 to which the trip latch 102 is coupled. The first portion 114 of the example spring housing 106 includes a flange 122 extending radially outwardly from the body portion 118. A number of protrusions 122,124 (two are shown) extend outwardly from the flange 120 toward the trip latch 102.

Figure 5:
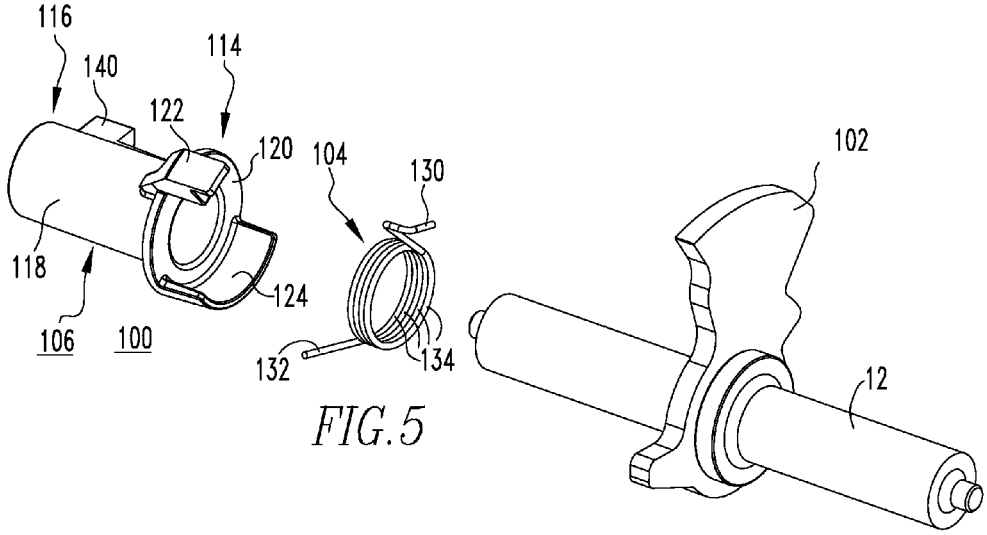
FIG. 5 is an exploded back isometric view of the trip latch assembly of FIG. 4.

As best shown in FIG. 5, the example spring housing 106 has a first protrusion 122 and a second protrusion 124. The first protrusion 122 extends outwardly form the aforementioned flange 120 and cooperates with the trip latch 102 and the trip latch reset spring 104 (best shown in FIG. 6). The second protrusion 124 at least partially overlays and retains the trip latch reset spring 104. More specifically, as shown in FIG. 5, the second protrusion 124 preferably comprises an arcuate molded portion that conforms to the shape of the spring 104. Accordingly, it will be appreciated that the trip latch reset spring 104 is preferably disposed on the shaft 12, between the flange 120 of the spring housing 106 and the trip latch 102.

Figure 3:
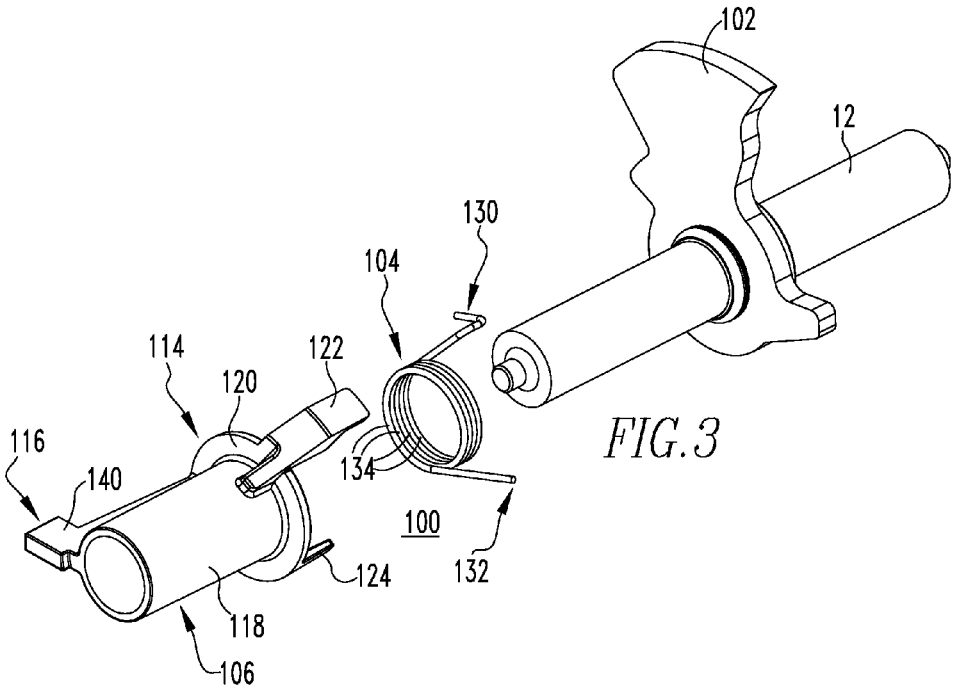
FIG. 3 is an exploded front isometric view of the trip latch assembly of FIG. 2.
Figure 4:
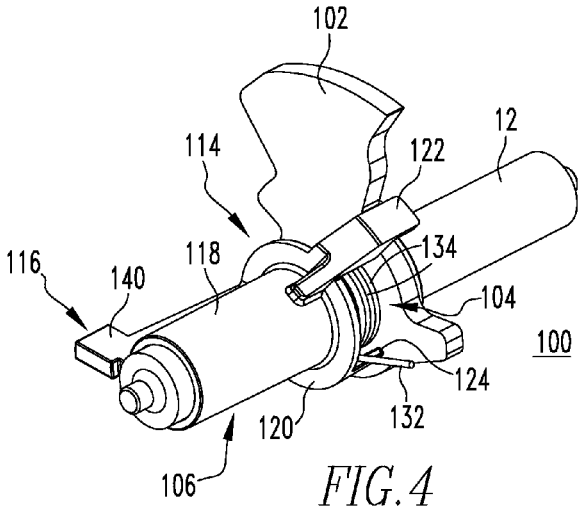
FIG. 4 is an assembled front isometric view of the trip latch assembly of FIG. 3.
Figure 6:
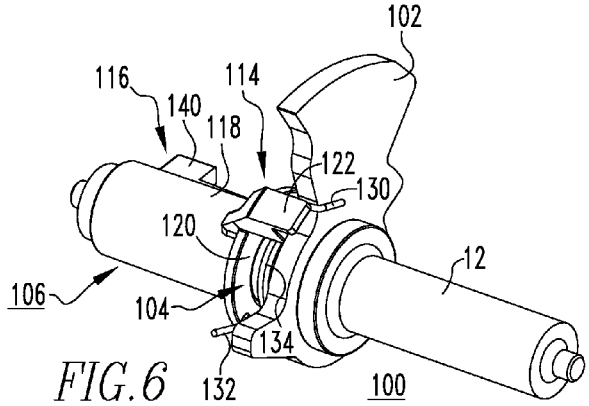
FIG. 6 is an assembled back isometric view of the trip latch assembly of FIG. 5.

In the example shown and described herein, the trip latch reset spring is a torsion spring 104. As best shown in FIGS. 3 and 5, the torsion spring 104 includes first and second ends 130,132 and a number of coils 134. The first end 130 of the torsion spring 104 engages the trip latch 102, as shown in FIG. 6, and the second end 132 engages the second protrusion 124. Both the first protrusion 122 and the second protrusion 124 preferably at least partially overlay the spring coils 134, as shown in FIGS. 4 and 6. In this manner, as previously discussed hereinabove, the spring housing 106 functions to control (e.g., without limitation, engage and disengage) the amount of spring bias supplied to the trip latch 102, when the spring housing 106 is manipulated by the trip latch spring link 108 (FIGS. 1 and 2). Among other benefits, the new construction of the spring housing 106 also enables the spring 104 to be adjusted, as desired, for example and without limitation, to provide the spring 104 with a predetermined amount of preload.

In other words, the first protrusion 122 acts as a radial stop for the trip latch 102 (see, for example, FIG. 6). This stop functions to remove all radial torque of the trip latch reset spring 104 and contains it in the assembly of the spring housing 106, spring 104, and trip latch 102.

Continuing to refer to FIGS. 3-6, and also referring again to FIGS. 1 and 2, operation of the trip latch spring link 108 to manipulate the spring housing 106 will now be described in greater detail. Specifically, in the example shown and described herein, the second portion 116 of the spring housing 106 includes a paddle 140, which extends outwardly from the body portion 118 of the spring housing 106. The second end 112 of the trip latch spring link 108 (FIGS. 1 and 2) is structured to cooperate with the paddle 140, in order to translate movement of the pole shaft 10 into movement of the spring housing 106. More specifically, the second end 112 of the trip latch spring link 108 preferably includes a recess 150 and an edge 152, wherein the paddle 140 extends into the recess 150, as shown in FIGS. 1 and 2. The paddle 140 cooperates with the edge 152 such that, when pole shaft 10 of the circuit breaker 2 pivots (e.g., without limitation, rotates counterclockwise in the direction of arrow 200 from the perspective of FIG. 1) and the trip latch spring link 108 is accordingly moved (e.g., without limitation, to the left in the direction of arrow 300 from the perspective of FIG. 1), the edge 152 of the second end 112 of the trip latch spring link 108 engages and pulls the paddle 140, thereby pivoting (e.g., without limitation, counterclockwise from the perspective of FIG. 1) the spring housing 106. Accordingly, it will be appreciated that the trip latch spring link 108 translates the movement of the pole shaft 10 into movement of the spring housing 106, when, and only when, it is desired to apply torque to the trip latch reset spring 104 to bias the trip latch 102 toward the latched position and reset the circuit breaker 2. It will be appreciated that at all other times, torsion or biasing force of the spring 104 is substantially removed from the trip latch 102.

In order to provide the aforementioned engaging and disengaging feature of the trip latch spring link 108 and, in particular, the spring housing 106 and trip latch reset spring 104, the first end 110 of the example trip latch spring link 108 preferably includes an elongated slot 160. The pole shaft 10 includes a pin member 14, which is movably disposed within the elongated slot 160. Accordingly, the rotational movement of the pole shaft 10 only functions to result in translational movement of the trip latch spring link 108 when the pin member 14 is fully engaged to move the trip latch spring link (e.g., without limitation, to the left in the direction of arrow 300 from the perspective of FIG. 1), as shown in FIG. 1. For example and without limitation, FIG. 1 shows the circuit breaker 2 and trip latch assembly 100 therefor in the positions associated with the circuit breaker 2 being tripped and discharged. Thus, the pole shaft 10 is indeed moving the trip latch spring link 108 in order to keep tension on the trip latch spring 104 to bias the trip latch 102 toward the latched position to reset the circuit breaker 2. In other instances, such as for example and without limitation, in FIG. 2 which shows the circuit breaker 2 and trip latch assembly therefor when the circuit breaker is closed, the trip latch spring link 108 is disengaged from the pole shaft 10, because the aforementioned pin member 14 is free to slide within the elongated slot 160. As such, the edge 152 on the first end 112 of the trip latch spring link 108 disengages the paddle 140 of the spring housing 106, and tension is released from the spring housing 106 and, therefore, from the trip latch reset spring 104.

Accordingly, the disclosed concept provides a unique trip latch assembly 100, which is structured to efficiently and effectively provide sufficient spring force to reset the circuit breaker 2, but wherein spring tension is removed when circuit breaker 2 is closed.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A trip latch assembly for an electrical switching apparatus, said electrical switching apparatus including a housing, separable contacts enclosed by the housing, and an operating mechanism for opening and closing said separable contacts, said operating mechanism including a pole shaft, said trip latch assembly comprising:

a trip latch structured to be pivotably coupled to the housing, said trip latch being movable between a latched position and an unlatched position;

a trip latch reset spring structured to bias said trip latch toward the latched position;

a spring housing at least partially overlaying said trip latch reset spring; and a trip latch spring link including a first end structured to be movably coupled to said pole shaft and a second end structured to cooperate with said spring housing, wherein, when said electrical switching apparatus needs to be reset, said trip latch spring link is structured to engage said spring housing, in order apply torque to said trip latch reset spring, and wherein, when said electrical switching apparatus is closed, the bias of said trip latch reset spring on said trip latch is removed.

2. The trip latch assembly of claim 1 wherein said spring housing comprises a first portion, a second portion disposed opposite and distal from the first portion, and a body portion extending between the first portion and the second portion; wherein the first portion cooperates with said trip latch reset spring; and wherein the second portion cooperates with said trip latch spring link.

3. The trip latch assembly of claim 2 wherein the housing of said electrical switching apparatus includes a shaft; wherein the body portion of said spring housing comprises an elongated sleeve member; and wherein said elongated sleeve member is structured to be disposed on said shaft.

4. The trip latch assembly of claim 3 wherein the first portion of said spring housing comprises a flange and a number of protrusions; wherein said flange extends radially outwardly from the body portion of said spring housing; and wherein said protrusions extend outwardly from said flange toward said trip latch.

5. The trip latch assembly of claim 4 wherein said number of protrusions is a first protrusion and a second protrusion; wherein said first protrusion cooperates with said trip latch and said trip latch reset spring; and wherein said second protrusion at least partially overlays and retains said trip latch reset spring.

6. The trip latch assembly of claim 5 wherein said trip latch reset spring is a torsion spring; wherein said torsion spring includes a first end, a second end, and a number of coils; wherein the first end of said torsion spring engages said trip latch; wherein the second end of said torsion spring engages said second protrusion; and wherein said first protrusion and said second protrusion at least partially overlay said coils.

7. The trip latch assembly of claim 6 wherein said torsion spring is structured to be disposed on said shaft between said flange of said spring housing and said trip latch.

8. The trip latch assembly of claim 2 wherein the second portion of said spring housing comprises a paddle extending outwardly from the body portion; and wherein the second end of the trip latch spring link is structured to cooperate with said paddle in order to translate movement of said pole shaft into movement of said spring housing.

9. The trip latch assembly of claim 8 wherein the second end of said trip latch spring link includes a recess and an edge; and wherein said paddle extends into said recess and cooperates with said edge.

10. The trip latch assembly of claim 9 wherein the first end of said trip latch spring link includes an elongated slot; wherein said pole shaft includes a pin member; and wherein said pin member is structured to move within said elongated slot in order that movement of said pole shaft is translated into movement of said spring housing only when it is desired to apply torque to said trip latch reset spring to bias said trip latch toward said latched position and reset said electrical switching apparatus.

11. An electrical switching apparatus comprising:

a housing;

separable contacts enclosed by the housing;

an operating mechanism for opening and closing said separable contacts, said operating mechanism including a pole shaft; and a trip latch assembly comprising:

a trip latch pivotably coupled to the housing, said trip latch being movable between a latched position and an unlatched position, a trip latch reset spring for biasing said trip latch toward the latched position, a spring housing at least partially overlaying said trip latch reset spring, and a trip latch spring link including a first end movably coupled to said pole shaft and a second end cooperating with said spring housing, wherein, when said electrical switching apparatus needs to be reset, said trip latch spring link engages said spring housing, in order apply torque to said trip latch reset spring, and wherein, when said electrical switching apparatus is closed, the bias of said trip latch reset spring on said trip latch is removed.

12. The electrical switching apparatus of claim 11 wherein said spring housing of said trip latch assembly comprises a first portion, a second portion disposed opposite and distal from the first portion, and a body portion extending between the first portion and the second portion; wherein the first portion cooperates with said trip latch reset spring; and wherein the second portion cooperates with said trip latch spring link.

13. The electrical switching apparatus of claim 12 wherein the housing of said electrical switching apparatus includes a shaft; wherein the body portion of said spring housing comprises an elongated sleeve member; and wherein said elongated sleeve member is disposed on said shaft.

14. The electrical switching apparatus of claim 13 wherein the first portion of said spring housing comprises a flange and a number of protrusions; wherein said flange extends radially outwardly from the body portion of said spring housing; and wherein said protrusions extend outwardly from said flange toward said trip latch.

15. The electrical switching apparatus of claim 14 wherein said number of protrusions is a first protrusion and a second protrusion; wherein said first protrusion cooperates with said trip latch and said trip latch reset spring; and wherein said second protrusion at least partially overlays and retains said trip latch reset spring.

16. The electrical switching apparatus of claim 15 wherein said trip latch reset spring is a torsion spring; wherein said torsion spring includes a first end, a second end, and a number of coils; wherein the first end of said torsion spring engages said trip latch; wherein the second end of said torsion spring engages said second protrusion; and wherein said first protrusion and said second protrusion at least partially overlay said coils.

17. The electrical switching apparatus of claim 16 wherein said torsion spring is disposed on said shaft between said flange of said spring housing and said trip latch.

18. The electrical switching apparatus of claim 12 wherein the second portion of said spring housing comprises a paddle extending outwardly from the body portion; and wherein the second end of the trip latch spring link cooperates with said paddle in order to translate movement of said pole shaft into movement of said spring housing.

19. The electrical switching apparatus of claim 18 wherein the second end of said trip latch spring link includes a recess and an edge; and wherein said paddle extends into said recess and cooperates with said edge.

20. The electrical switching apparatus of claim 19 wherein the first end of said trip latch spring link includes an elongated slot; wherein said pole shaft includes a pin member; and wherein said pin member is movable within said elongated slot in order that movement of said pole shaft is translated into movement of said spring housing only when it is desired to apply torque to said trip latch reset spring to bias said trip latch toward said latched position and reset said electrical switching apparatus.

* * * * *